US009423112B2

(12) United States Patent
Zanotto et al.

(10) Patent No.: US 9,423,112 B2
(45) Date of Patent: Aug. 23, 2016

(54) LIGHT FIXTURE

(71) Applicant: OSRAM GmbH, Munich (DE)

(72) Inventors: Alberto Zanotto, Padova (IT); Simon Bobbo, Chirignago (IT); Franco Zanon, Cassola (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/402,694

(22) PCT Filed: May 23, 2013

(86) PCT No.: PCT/EP2013/060631
§ 371 (c)(1),
(2) Date: Nov. 21, 2014

(87) PCT Pub. No.: WO2013/174929
PCT Pub. Date: Nov. 28, 2013

(65) Prior Publication Data

US 2015/0117005 A1 Apr. 30, 2015

(30) Foreign Application Priority Data

May 25, 2012 (IT) ..... TO2012A0453

(51) Int. Cl.

| | |
|---|---|
| ***F21V 21/26*** | (2006.01) |
| ***F21V 23/06*** | (2006.01) |
| ***F21S 4/00*** | (2016.01) |
| ***F21K 99/00*** | (2016.01) |

(52) U.S. Cl.
CPC . *F21V 21/26* (2013.01); *F21K 9/30* (2013.01); *F21S 4/28* (2016.01); *F21V 23/06* (2013.01)

(58) Field of Classification Search
CPC ..... F21V 21/26; F21V 21/30; F21V 23/06; F21K 9/30; F21Y 2101/02; F21Y 2103/003; F21S 4/008; F21S 4/28
See application file for complete search history.

(56) References Cited

U.S. PATENT DOCUMENTS

| | | | | |
|---|---|---|---|---|
| 3,619,599 | A * | 11/1971 | Hermanson | A47G 33/08 362/249.16 |
| 4,890,206 | A | 12/1989 | Lee | |
| 5,552,974 | A | 9/1996 | Tsai | |
| 6,273,583 | B1 * | 8/2001 | Trisler | B44C 3/12 362/121 |
| 7,726,840 | B2 * | 6/2010 | Pearson | F21S 2/005 362/249.01 |
| 2012/0140474 | A1 * | 6/2012 | Jurik | F21S 2/00 362/249.09 |

FOREIGN PATENT DOCUMENTS

| | | | | |
|---|---|---|---|---|
| BE | 378613 | | 3/1931 | |
| DE | 589554 | | 12/1933 | |
| EP | 0353220 | A2 * | 1/1990 | F21S 6/003 |
| GB | 137736 | | 1/1920 | |

OTHER PUBLICATIONS

International Search Report dated Aug. 5, 2013.

* cited by examiner

*Primary Examiner* — Alan Cariaso
(74) *Attorney, Agent, or Firm* — Viering, Jentschura & Partner mbB

(57) ABSTRACT

A light fixture may include a plurality of elongate members, each extending between opposed ends and carrying one or more light radiation sources, such as LEDs, and at least one hinge member which mechanically couples one end of one of the elongate members to one end of another of the elongate members. Thus the hinge member allows the orientation of the elongate members between: an open position, wherein the elongate members extend in sequence with each other in a common direction, and a closed position, wherein the elongate members extend side by side.

16 Claims, 2 Drawing Sheets

LIGHT FIXTURE

RELATED APPLICATIONS

The present application is a national stage entry according to 35 U.S.C. §371 of PCT application No.: PCT/EP2013/060631 filed on May 23, 2013, which claims priority from Italian application No.: TO2012A000453 filed on May 25, 2012, and is incorporated herein by reference in its entirety.

TECHNICAL FIELD

Various embodiments relate to light fixtures. Various embodiments may relate to light fixtures using LED sources as light radiation sources.

BACKGROUND

By using mounting supports such as printed circuit boards (PCBs) of a flexible type, having a strip structure for example, for the mounting of light radiation sources such as LEDs, it is possible to make flexible light fixtures in which the support can be flexed in a "vertical" direction, in other words in an orthogonal plane relative to the plane of extension of the support.

However, it is practically impossible to flex or bend this type of support in the plane of extension of the support.

Furthermore, flexible board supports are often limited to operation with low-power components. In this connection, the inventors have observed that even the use of light radiation sources such as side emitting LEDs is in fact constrained by the intrinsically low luminous flux of these components, causing the range of applications to be limited.

The inventors have also observed that, in order to extend the possibility of application to trajectories including acute angles, for example in order to create lighting configurations of special shapes, if common types of lighting modules such as LED modules are used, it is necessary to use special connectors or wire bonding, resulting in a rather low level of adaptability.

SUMMARY

Consequently there is a demand for light fixtures, of the solid state type for example (such as LED light fixtures), which have a shape that can be adapted easily by the end user to make them suitable for application, for example, in corner areas, without resulting in any reduction in the optical performance or the lighting coverage, while enabling modular structures to be provided if necessary.

Various embodiments have the purpose of providing a response to the aforesaid demand.

Various embodiments enable one or more of the following advantages to be obtained:

- the possibility of providing light fixtures of different shapes using a single module,
- the availability of a bendable or flexible module with high-power light radiation sources, such as LED sources,
- the possibility of modifying the length of the light fixture, for example by adding (or removing) one or more modules,
- the possibility of connecting the modules forming the light fixture over a wide range of angles of relative orientation, and
- the possibility of connecting different modules in a simple and rapid manner.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1:
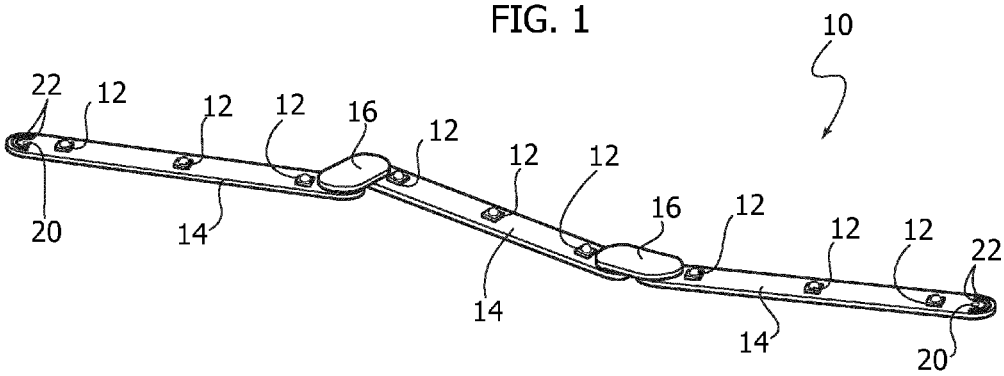
FIGS. 1 to 3 show some embodiments in various possible positions of use.

The following description illustrates various specific details intended to provide a deeper understanding of various embodiments. The embodiments may be produced without one or more of the specific details, or with other methods, components, materials, etc. In other cases, known structures, materials or operations are not shown or described in detail, in order to avoid obscuring various aspects of the embodiments.

The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in any suitable way in one or more embodiments.

The references used herein are provided purely for convenience and therefore do not define the scope of protection or the extent of the embodiments.

In the drawings, the reference 10 indicates the whole of a light fixture which can use light radiation sources in the form of solid state light radiation sources 12, such as LED sources.

The light fixture 10 has a modular structure and includes a plurality of members of elongate shape 14.

In various embodiments, the elongate members 14 may be flat and/or straight.

In various embodiments, the elongate members 14 may be made in the form of printed circuit boards.

Figure 2:
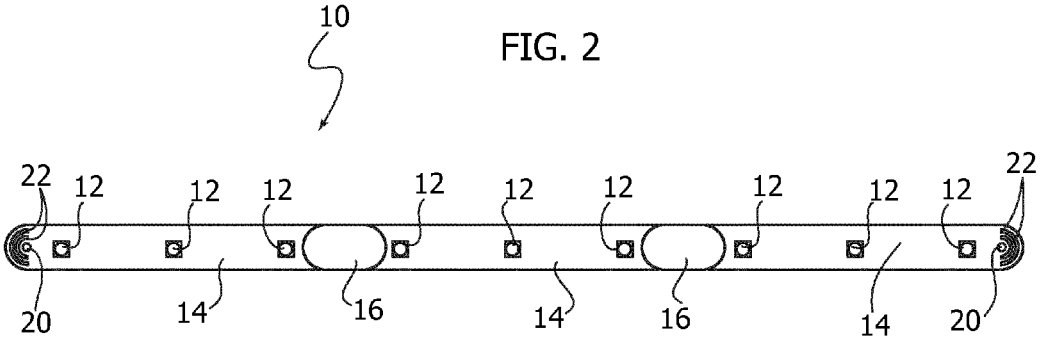
Figure 3:
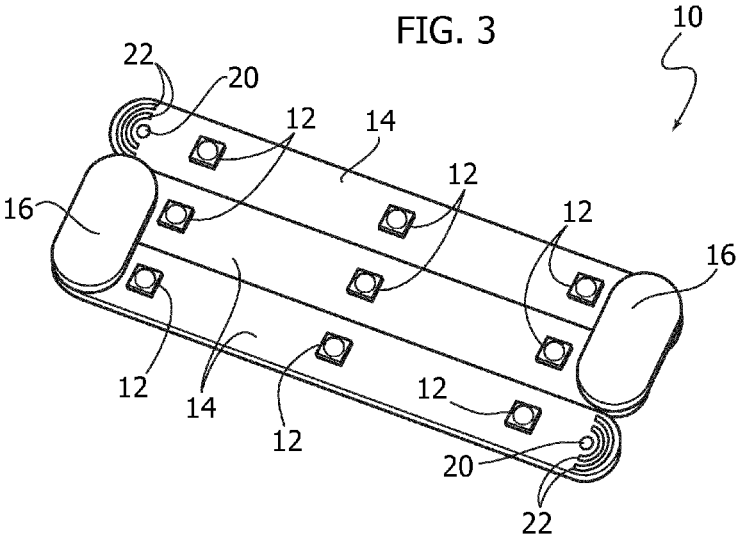
Figure 4:
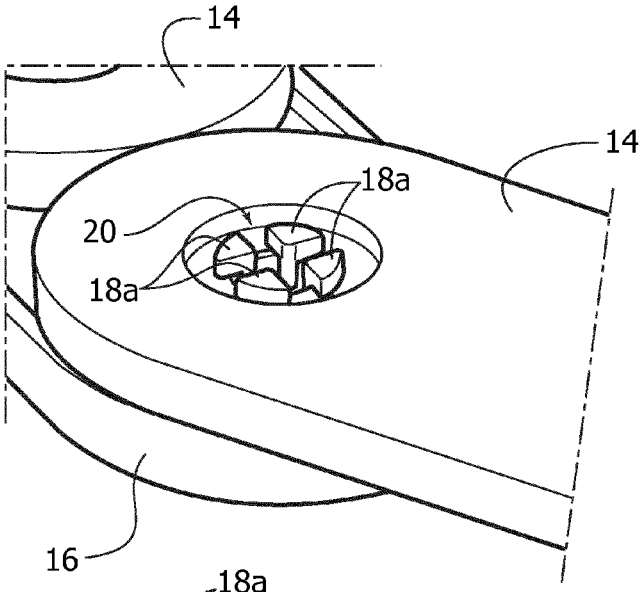
FIGS. 4 to 6 show components of some embodiments in greater detail.

In the embodiments shown in FIGS. 1 to 3, the source 10 includes three members 14. However, because of the modular structure which is described further below, the source 10 may include any number n of members 14, where n is for example equal to 2, 3, 4, . . . .

In various embodiments, each member 14 can carry one or more light radiation sources 12.

In various embodiments, the members 14 can be connected by hinge joint members 16, each of which mechanically connects one end of one of the members 14 to an end of another adjacent member 14.

In various embodiments, the hinge connection formed between the hinge members 16 (which can be provided, in various embodiments, according to the principles described more fully below) allows the two members 14 connected by the member or each member 16 to be oriented between:

- an open position, wherein the two members 14 connected by a hinge member 16 extend in a common direction, virtually in sequence with each other, as shown schematically in FIG. 2, and
- a closed position, wherein the two members 14 connected by the hinge member or by each hinge member 16 extend side by side, as shown schematically in FIG. 3.

In various embodiments, the aforesaid hinge connection also allows the two members 14 connected by the hinge member or by each hinge member 16 to be oriented in all the intermediate angular positions between the aforementioned open and closed positions, such that the source 10 is given a generally polygonal or serpentine, zigzag shape, as shown schematically in FIG. 1.

In various embodiments, with the members 14 adjacent in the aforesaid open condition, the members 14 may (all) be aligned with each other and the light fixture 10 may take the form of a straight fixture of elongate shape, shown in FIG. 2 with the light radiation sources 12 aligned with each other. In various embodiments, the light radiation sources 12 may be mounted on the members 14 in such a way that, in the open condition of FIG. 2, the light radiation sources 12 have a constant spacing distance or interval (or pitch) between them.

In various embodiments, with the adjacent members 14 in the aforesaid closed condition, the members 14 may (all) lie against each other and the light fixture 10 may take the form of a panel as shown in FIG. 3, with the light radiation sources 12 ordered in a matrix arrangement in rows and columns.

Figure 5:
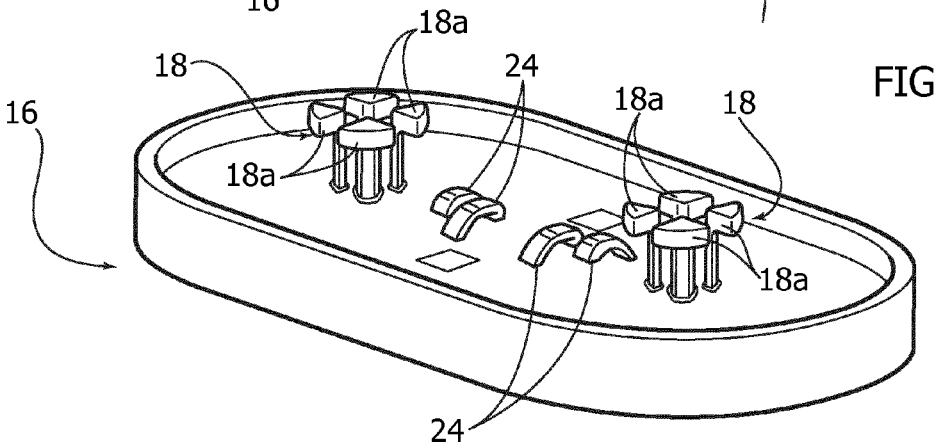
Figure 6:
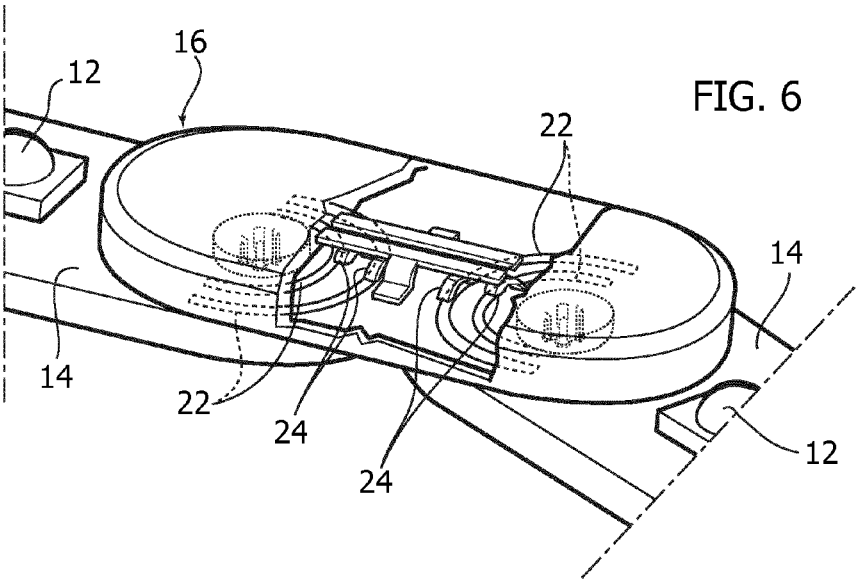

In various embodiments, the mechanical connection of the members 14 and the members 16 may be formed by means of a pin-and-hole coupling. This may be done, for example, as shown in FIG. 5, in other words by providing two pins 18 on the hinge member 16.

In various embodiments, the two pins 18 in question may be made in one piece with the body of the member 16.

In various embodiments, the two pins 18 may be split longitudinally so as to be resiliently contractible in the radial direction. The pins 18 can thus be inserted in a general snap-fitting arrangement in corresponding holes 20 provided in end positions in the elongate members 14.

In various embodiments, the pins 18 may have distal ends 18*a* molded in an L shape such that they can penetrate into a corresponding hole 20 and then snap into an expanded configuration on emerging from the opposite end of the hole 20. In various embodiments, it is thus possible to provide a fastening that prevents the undesired disengagement of the members 14 from the hinge member 16 intended to connect them, while retaining the capacity for relative orientation. In a complementary way, the members 14 and 16 can be separated by radially contracting the pins 18 (by means of an operation which may be manual, without the use of special tools), for example in order to remove a member 14 from the modular structure of the light fixture 10.

In various embodiments, the pin-and-hole connection arrangement described herein could be made in a complementary manner, in other words by providing the pins 18 on the elongate members 14 and the apertures 20 in the hinge joint member 16.

Regardless of the solution chosen, the connection arrangement described makes it possible to connect (and separate) a variable number of elongate members 14 by a simple operation of pressing the upper face of the connection element 16, without the need to use tools such as screwdrivers or the like.

In various embodiments, the hinge member or each hinge member 16 not only couples two adjacent members 14 together mechanically, but can also provide an electrical connection between two adjacent members 14, so as to allow the propagation of electrical signals (of the power and/or control type) along the light fixture, for example by means of conductive lines extending along the elongate members 14 (these lines being embedded in the members, for example).

In various embodiments, the electrical connection between adjacent members 14 may require the presence of curved electrically conductive tracks 22 which emerge along trajectories which are circular (semicircular, for example) at end positions on the members 14.

In various embodiments, the trajectories in question may be substantially centered on the common axis of the hole 20 (and the pin 18) which form the hinge coupling described above.

In the exemplary embodiments illustrated herein, two semicircular tracks 22 are provided at the ends of each member 14. Clearly, this is a possible exemplary embodiment belonging to the type of embodiment in which the light radiation sources 12 mounted on each member 14 are interconnected in a homologous way, for example between two conductors acting, respectively, as a power conductor (+V d.c.) and as a ground conductor.

In various embodiments, the number of conductive tracks 22 may be different, thus providing, for example, in addition to a power line (+V d.c.) and a ground line, a "signal" line for transmitting "intelligent" control signals, such as a signal for regulating the luminous intensity (known as "dimming"), to the light radiation sources 12.

In order to interconnect the conductive tracks or paths 22 mounted on two adjacent members 14, the hinge joint member 16 may carry electrical contacts 24.

In various embodiments, the electrical contacts 24 may be provided at each end of the member 16 in a number equal to the number of tracks 22 present at the end of each member 14 (this number being two in the examples illustrated herein).

In various embodiments, these electrical contacts may be provided in the form of sprung contacts 24 having a generally slider-like configuration so as to allow electrical contact to be maintained regardless of the relative orientation of the hinge member 16 and each of the elongate members 14 connected by it.

In the exemplary embodiments illustrated herein, the trajectories of the contact tracks 22 extend over an arc substantially equal to 180°, and the slider contacts 24 can provide electrical contact over this angle of possible orientation by sliding on the tracks 22.

As in the case of the mechanical connection provided by means of the pins 18 and the apertures 20, in various embodiments the electrical connection could be provided in a complementary manner to those illustrated here by way of example, in other words by providing curved tracks such as the tracks 22 on the hinge joint member 16 and slider contacts 24 on the elongate member 14.

In various embodiments, the solution described herein makes it possible to provide the fixture 10 with properties of modularity and adaptability to the requirements of the end user, both as regards the number of members 14 (and consequently the number of light sources 12), and as regards their relative angular positioning. The principle of connection described above can therefore ensure the "longevity" of the product from the user's point of view.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A light fixture comprising:

a plurality of elongate members each extending between opposed ends and carrying at least one light radiation source, at least one hinge member for mechanically coupling one end of one of said elongate members to one end of another of said elongate members, said hinge member allowing the orientation of said one and said other elongate members between:

an open position, wherein said one and said other elongate members extend in sequence with each other in a common direction, and a closed position, wherein said one and said other elongate members extend side by side, wherein said at least one hinge member carries parts of two opposed pin-and-hole coupling arrangements for coupling to said one and said other of said elongate members, wherein said pin-and-hole coupling arrangement includes a pin which is radially contractible for insertion into a corresponding hole, wherein said pin is a split pin including a plurality of resilient L-shaped elements having a distal portion for snap engagement beyond said hole.

2. The light fixture as claimed in claim 1, wherein the pin of said pin-and-hole coupling is carried by said hinge member.

3. The light fixture as claimed in claim 1, further comprising, between said at least one hinge member and each of said one and said other elongate members, an electrical connection device including:

curved electrically conductive lines, and slider contacts for slidably contacting said curved conductive lines.

4. The light fixture as claimed in claim 3, wherein the slider contacts in said electrical connection device are carried by said hinge member.

5. The light fixture as claimed in claim 1, further comprising light radiation sources mounted on said elongate members in positions resulting in a constant spacing interval of the light radiation sources when said elongate members are in said open position.

6. The light fixture as claimed in claim 1, wherein said elongate members are flat and/or rectilinear.

7. The light fixture as claimed in claim 1, wherein said light radiation sources are solid state light radiation sources.

8. A light fixture comprising:

a plurality of elongate members each extending between opposed ends and carrying at least one light radiation source, at least one hinge member for mechanically coupling one end of one of said elongate members to one end of another of said elongate members, said hinge member allowing the orientation of said one and said other elongate members between:

an open position, wherein said one and said other elongate members extend in sequence with each other in a common direction, and a closed position, wherein said one and said other elongate members extend side by side, an electrical connection device between said at least one hinge member and each of said one and said other elongate members, the electrical connection device including:

curved electrically conductive lines, and slider contacts for slidably contacting said curved conductive lines.

9. The light fixture as claimed in claim 8, wherein said at least one hinge member carries parts of two opposed pin-and-hole coupling arrangements for coupling to said one and said other of said elongate members.

10. The light fixture as claimed in claim 8, wherein said pin-and-hole coupling arrangement includes a pin which is radially contractible for insertion into a corresponding hole.

11. The light fixture as claimed in claim 10, wherein the pin of said pin-and-hole coupling is carried by said hinge member.

12. The light fixture as claimed in claim 8, wherein said pin is a split pin including a plurality of resilient L-shaped elements having a distal portion for snap engagement beyond said hole.

13. The light fixture as claimed in claim 8, wherein the slider contacts in said electrical connection device are carried by said hinge member.

14. The light fixture as claimed in claim 8, further comprising light radiation sources mounted on said elongate members in positions resulting in a constant spacing interval of the light radiation sources when said elongate members are in said open position.

15. The light fixture as claimed in claim 8, wherein said elongate members are flat and/or rectilinear.

16. The light fixture as claimed in claim 8, wherein said light radiation sources are solid state light radiation sources.

* * * * *